US009222027B1

(12) United States Patent
Malone et al.

(10) Patent No.: US 9,222,027 B1
(45) Date of Patent: Dec. 29, 2015

(54) SINGLE STAGE PITCH PROCESS AND PRODUCT

(71) Applicants: Donald P. Malone, Grayson, KY (US); Donald M Lee, Huntington, WV (US)

(72) Inventors: Donald P. Malone, Grayson, KY (US); Donald M Lee, Huntington, WV (US)

(73) Assignee: Advanced Carbon Products, LLC, Hitchins, KY (US)

( * ) Notice: Subject to any disclaimer, the term of this patent is extended or adjusted under 35 U.S.C. 154(b) by 296 days.

(21) Appl. No.: 13/794,678

(22) Filed: Mar. 11, 2013

Related U.S. Application Data

(60) Provisional application No. 61/686,684, filed on Apr. 10, 2012.

(51) Int. Cl.

| | |
|---|---|
| ***C10C 3/02*** | (2006.01) |
| ***C10G 9/14*** | (2006.01) |
| ***C10C 3/00*** | (2006.01) |
| ***C10G 9/24*** | (2006.01) |
| ***C10G 9/40*** | (2006.01) |

(52) U.S. Cl.
CPC ..... *C10C 3/002* (2013.01); *C10C 3/026* (2013.01); *C10G 9/14* (2013.01); *C10G 9/24* (2013.01); *C10G 9/40* (2013.01); *C10G 2300/1096* (2013.01); *C10G 2300/4006* (2013.01); *C10G 2300/4012* (2013.01)

(58) Field of Classification Search
CPC ..... C10C 3/002; C10C 3/005; C10C 3/025; C10G 9/005; C10G 9/14; C10G 9/24; C10G 9/40
See application file for complete search history.

(56) References Cited

U.S. PATENT DOCUMENTS

| | | | | |
|---|---|---|---|---|
| 3,140,248 | A * | 7/1964 | Folda, Jr. et al. | 208/40 |
| 3,318,801 | A | 5/1967 | Alexander | |
| 3,673,077 | A | 6/1972 | Roza | |
| 3,970,542 | A | 7/1976 | Bongertman | |
| 4,096,056 | A | 6/1978 | Haywood et al. | |
| 4,581,124 | A * | 4/1986 | Gomi et al. | 208/72 |
| 4,663,022 | A * | 5/1987 | Gomi et al. | 208/67 |
| 4,925,547 | A | 5/1990 | Tsuchitani et al. | |
| 6,352,637 | B1 | 3/2002 | Doolin et al. | |
| 7,318,890 | B1 * | 1/2008 | Malone | 208/41 |

* cited by examiner

*Primary Examiner* — Renee E Robinson
(74) *Attorney, Agent, or Firm* — Richard D. Stone

(57) ABSTRACT

A process and apparatus for making isotropic pitch are disclosed. A tubular reactor operating at high velocity and pressure converts aromatic rich liquid feed to pitch within minutes. Reactor is heated by electric resistance or inductance, a salt or molten metal bath, or fired heater. Reactor effluent flashes and isotropic pitch recovered from the flash drum. Softening point is affected by flash drum pressure or stripping steam. Unconverted feed may be recycled. Process makes little gasoline, simple condensation of flash drum vapor may produce gas oil and gasoline fractions. Isotropic pitch is made in a single step with a coking value of 50 to 55 wt %. Time and temperature in the reactor convert at least 20 wt % of feed and any recycle material present to isotropic pitch. Pressure is preferably above 500 psig, to suppress mesophase formation and produce isotropic pitch with less than 0.5 wt % mesophase.

20 Claims, 5 Drawing Sheets

SINGLE STAGE PITCH PROCESS AND PRODUCT

CROSS REFERENCE TO RELATED APPLICATIONS

This application claims the benefit of prior application No. 61/686,684, filed Apr. 10, 2012, which is incorporated by reference.

BACKGROUND

1. Field of the Invention

This invention relates to a continuous process for the manufacture of highly aromatic pitches from aromatic oils for use in producing molded carbonaceous articles such as anodes used in aluminum manufacture, impregnation pitch, and the manufacture of carbon artifacts, general purpose fibers, conversion into mesophase and high performance fibers.

2. Prior Art

The term "pitch" denotes a wide range of products. The term goes back to at least the description of Noah's Ark given in the book of Genesis in the Old Testament. Some commentators opined that Noah "cooked" pine sap in a clay pot, inducing thermal polymerization to form a higher softening point material. Others have suggested that Noah's pitch was charcoal mixed with boiling pine tar. Still others have suggested that Noah used natural oil seeps. No one knows what pitch process Noah used and even today the term pitch is used to denote both naturally occurring heavy materials, such as seeps and those formed by thermal polymerization of lighter materials, such as pine sap cooked in a clay pot.

Many patents and technical papers on pitch production exist. These can present an overwhelming and difficult to understand picture of the state of the art of pitch production. There are multiple process approaches to make each product, or at times to make multiple products. In addition to the published art on pitch making, there is much unpublished lore on the difficulties of making pitch without coking up the heaters and shutting the process down, though some of this difficulty can be inferred by the extreme steps taken to stop thermal polymerization just short of coking.

The confusion in naming terminology comes about from widespread use of heavy products. Both residual products from whole crude fractionation and the product of thermal polymerization of a distilled feedstock have been called pitch. A residual material such as asphalt can be made from crude oil that is a complex mixture of hydrocarbons, some of which are so heavy or high in molecular weight as to be essentially non-distillable. The non-distillable residue from such heavy crude is an asphaltic fraction, but is sometimes referred to as pitch. A pitch product as used herein is the result of thermally induced polymerization of an aromatic rich liquid feed material usually obtained by distillation. The aromatic rich liquid is given sufficient thermal treatment to induce thermal polymerization, some thermal cracking, and thermal dealkylation. One product is a mix of components lighter than the feed and the other, a thermally polymerized heavy product that is essentially non-distillable.

The two materials asphalt and pitch are easy to distinguish in practice. A simple test illustrates the different natures of the two materials. Heat a liter or so of each and pour it on a desk. The asphalt forms a sticky mess that is difficult to remove. A petroleum or coal tar pitch forms a glassy solid that after being hit with a hammer shatters into pieces that can be cleanly swept up in a dustpan leaving a relatively clean desk.

There are many processes to make petroleum or coal tar pitch, i.e., the thermally polymerized product. Part of the reason for the proliferation of processes is that many approaches work well in the lab but not in practice. Pitch processes can be difficult to run, as evidenced by few commercial processes still in operation. All pitch processes require heat to induce thermal polymerization. Some processes require air or oxygen addition, others require the exclusion of air. Wide ranges of temperature and pressure are mentioned, as well as various residence times and flow regimes, from long soaking time to turbulent flow in preheaters.

The primary pitch forming reactions are thermal, not catalytic, so it is possible to compare to some extent the "severity" of pitch forming reactions in one patent to conditions reported in another. The primary mechanism for pitch formation is thermal polymerization. Other reactions go on as well, including thermal cracking, thermal dealkylation of alkyl side chains of large molecules in the feed, and breakdown of complex large molecules, such as porphyrins. The desired pitch product is primarily made by thermally induced polymerization. Most of the other reactions, e.g., thermal cracking and dealkylation, are also thermal reactions and so their contribution to pitch formation and byproduct formation can also be quantified using time and temperature. Because of the importance of understanding what is different about our new process from the old, a review of refining history and various thermal processes is needed.

A spectrum of thermal processes exists. Visbreaking, the mildest thermal treatment, thermally cracks or thermally dealkylates a heavy petroleum fraction to generate "in situ" a cutter stock, reducing the viscosity of the heavy feed. Visbreaking makes modest amounts of gasoline and lighter material. Refiners recognized that the gasoline boiling range material obtained by thermal cracking had a higher octane than a like boiling range material obtained by distilling or recovering natural gasoline. The cracked gasoline had higher olefin content and a higher octane than the natural gasoline fraction removed from the crude oil to produce a heavy visbreaker feed. The higher octane of and increased demand for gasoline led many refiners to incorporate thermal cracking processes into their refineries. Universal Oil Products developed and widely licensed a thermal cracking process, with one feature being "a guaranteed 23% yield of gasoline" and a 24 hour run before cleanout was required because the early units coked rapidly. Avidan et al., "Fluid Catalytic Cracking Report", *Oil & Gas Journal*, Jan. 8, 1990. Another early cracking process, the four-case Houdry unit, used catalyst and high temperature with a 24 minute cycle time. The reactors coked so rapidly that only six minutes of on-stream time was possible before decoking was required. Avidan, op cit.

The most severe thermal process is coking which can thermally polymerize and thermally crack a heavy residual feed into a low value coke and more valuable lighter products. The coke is usually a distress product, but the lighter products that contain large amounts of olefins and dienes can be converted into gasoline. Coking conditions are so severe that long chain molecules are cracked into olefinic molecules that in turn are cracked to form reactive dienes. The aromatic molecules are cracked and/or thermally polymerized all the way to a solid or coke product. Coker naphtha is one of the main byproducts, but is unstable and difficult to process primarily because of the diene content. If attempts are made to process it in a typical fired heater in a refinery, the heater will coke up in a day or two. If coker naphtha is used in a car as gasoline, it forms gum and rapidly clogs filters, injectors and the like.

Thermal severity ranged from mild to severe. To quantify where a refinery process was on the thermal severity spectrum and compare one visbreaker to another when temperatures and flow rates were not the same was difficult. Thermal reactions increased exponentially and roughly doubled for every 10° C. increase in temperature. Because temperatures of around 800° F. were widely used for visbreaking, refiners introduced the concept of Equivalent Reaction Time at 800° F., or ERT seconds. Visbreaking is kinetically a first-order reaction. The severity of visbreaking is often expressed as ERT (equivalent residence time at 800° F. in seconds) and is calculated by multiplying the cold oil residence time above 800° F. by the ratio of relative reaction velocities as defined by Nelson (W. L. Nelson, *Petroleum Refinery Engineering*, 4*th Ed.*, FIG. 19-18, page 675) taking into consideration the temperature profile across the visbreaker coil, using the average temperature for each one foot segment of the coil above 800° F. Although developed for visbreaking, the same kinetics and approach may be used to quantify severity of a pitch process. There are some flaws in this approach. It uses a liquid residence based on cold oil, and refiners know that the composition in the visbreaking coil, and soaker if used, changes constantly. Light gas and gasoline boiling range material are produced in ever greater quantities as the liquid feed progresses through the thermal process. This gas can displace liquid if some type of slugging flow develops or can force liquid to the walls of the tubes while gas rapidly exits via the central portion. Despite the possible flaws, the industry in those early days adopted the ERT concept and used it to compare one visbreaker to another, or refer to the severity of a coking process. Pitch formation, i.e., thermally induced polymerization of aromatic molecules to form pitch with a softening point of 200-400° F. or higher requires more severe thermal processing than visbreaking, but less severe operation than coking.

As used herein, all references to severity in terms of ERT or ERT seconds are intended to mean the equivalent severity at 800° F. in seconds, as calculated using the Nelson procedure, described above, regardless of the actual temperature or temperatures used.

ERT is a way to compare severity and predict product yields from a given charge stock subjected to a given thermal treatment.

To summarize, visbreaking or thermal cracking achieves moderate conversion of heavy feed to lighter products including an olefinic naphtha. Coking achieves complete conversion of heavy feed to lighter products such as coker naphtha, but the olefin and especially the diene contents of the naphtha are so high that further treatment is needed. Large complex refineries have the specialized equipment needed to process coker naphtha. Typically either a treatment at relatively low temperature over proprietary catalyst to saturate the dienes or mixing with conventional naphtha and hydrotreating at two to three times the pressure required for the hydrotreating other refinery naphtha fractions is used. The severe hydrotreating of coker naphtha saturates the olefins significantly reducing the octane, so further treatment as in a platinum reformer is needed.

A given crude oil, or fraction thereof, subjected to a typical visbreaking severity of 800 ERT seconds will give essentially the same yield of gas and liquid products with essentially the same product composition. It matters not if the actual temperature used to process the feed was above 800° F. for a time shorter than 800 seconds, or below 800° F. for a longer period, the amount of thermal processing or thermal severity of the treatment will be the same. If two feedstocks have different chemical composition then the products from thermal processing will be different, even though the thermal severity used to treat the two feeds was identical. Thus ERT or some similar method of comparing the severity of one thermal process to another is an important and useful concept in understanding our and prior art processes.

Although it is possible to calculate with great accuracy an ERT, in practice it is hard to determine what ERT was used in a particular process. Many experiments reported in the patent literature may not include enough detail about, e.g., liquid residence time to permit an accurate calculation. Although the ERT calculation is based on cold liquid feed rate, minor amounts of vapor can occupy a major amount of space in a reactor so liquid residence times and ERT's can vary greatly as compared to what would be calculated assuming everything in a tube or pipe was in liquid phase. In addition, not much is known about the flow regimes in tubes for exceedingly heavy liquid products. There may be some sort of slugging flow in which the liquid moves through a pipe in slugs or liquid may collect as an annulus on the walls of a pipe while vapor goes rapidly through the central portion of the pipe. In this type of flow the liquid residence time can much greater than expected. Despite these difficulties and uncertainties, ERT is a useful and helpful concept for analyzing what goes on in a pitch process and in comparing one pitch process to another.

Physical properties of various pitches can be as different as their end uses. On a crude level, the softening point and coking value can vary greatly depending on how severe the pitch processing was and how much light material was left in or added to the residual pitch product. For some uses such as the manufacture of clay pigeons for target shooting, any pitches potentially can be used. For binder pitch used to form anodes for aluminum production, pitches from petroleum or from coal tar may be used, but coal tar pitch is preferred due to its high coking value. For impregnation of electrodes used in electric arc furnaces for steel manufacture, petroleum pitch e.g., made from FCC slurry oil is superior to all other commercially available pitches. For manufacture of carbon fibers, special high softening point pitches, usually having a softening point above 300° F. or higher are needed. Petroleum pitches are generally preferred but coal tar pitch, with additional treatment steps may also be used. If there are concerns about BPA or other carcinogens, these can be significantly higher in coal tar pitch than petroleum pitch.

Although pitch manufacturing has been practiced for millennia, the process is not easy. It is easy to take any polymerizable material, pine resin, coal tar, slurry oil or the like and heat it to induce thermal polymerization and make pitch. The hard part of the process is avoiding going too far, since the end point of thermal polymerization is coke. Coke fouls the process equipment and contaminates the pitch product.

Some processes take advantage of the propensity of heavy residual feeds to form coke. Athabasca tar sands are too heavy to process in a conventional refinery. Many heavy crudes are both too viscous and contain too much metal and other impurities to permit refining in a conventional refinery. For such difficult feeds refiners have installed cokers that heat the difficult feed to a temperature sufficient to induce thermal reactions and let the heated feed sit in a coke drum for hours or days. Most of the feed, typically about ⅔ by weight, is converted to lighter products, such as coker naphtha or coker gas oil. These can be processed with some difficulty in a conventional refinery. About one third of the feed ends up as coke that is a low value product. When high quality feeds such as slurry oils from a catalytic cracking unit or ethylene cracker bottoms are available and high quality coke products are desired, thermal processing can be used to produce high value products, e.g. needle coke.

Most coke is made from heavy hard-to-process feeds. Aromatic carbon rich feeds coke so reliably when heated to coking temperatures that coking is the only large scale batch process conducted in modern refineries. Thermal processing of heavy feeds is relatively easy when the goal is to make coke. Heat the feed enough to induce thermal polymerization and give it enough time, it will inevitably form coke. In contrast, thermal processing is difficult when the end product is something short of coke.

When isotropic pitch is the desired product, more problems can exist, even if conditions are selected to minimize coke formation. Pitch must have uniform properties. Coke is an obvious problem on the road to pitch while mesophase—the penultimate stop on the road to pitch—is hard to see and even harder to avoid. Mesophase pitch and isotropic pitch are often produced simultaneously and unintentionally. They have different densities, viscosities, etc. The presence of modest amounts of mesophase in an isotropic pitch product destroys most of the value of the isotropic pitch.

In order to appreciate the measures pitch manufacturers take to avoid making coke or mesophase-contaminated isotropic pitch, various pitch making processes will be reviewed. In general, producers limit coke formation by limiting conversion. Mesophase contamination is avoided by limiting conversion or by allowing some mesophase or precursors thereof to form, followed by solvent extraction of the desirable pitch product. Some isotropic pitch processes will be reviewed first.

In all processes using thermal polymerization, it is hard to achieve this polymerization without coking up the heater tubes used to reach these extreme temperatures. Hot metal surfaces promote coke formation on the walls of the tubes in the heaters and cause rapid fouling. Shifting some heating from a fired heater to internal combustion or other reactions with hot feedstock can reduce fouling. In U.S. Pat. No. 4,096,056 by Haywood and U.S. Pat. No. 3,725,240 by Baum, petroleum pitch manufacture by heat treatment and air blowing of slurry oil are disclosed. These processes produce pitches suitable for low value uses such as those in which nearly any pitch is satisfactory; however, for high end uses especially as precursors for carbon fiber manufacture, pitches produced from air blowing are not satisfactory.

In U.S. Pat. No. 3,970,542 by Bongertman, coal tar is mixed with aromatic petroleum fractions and heat-treated. Bongertman claims that carbon particles in the coal tar catalyze the formation of heavier aromatic molecules in both the coal tar and in the petroleum fraction during heat-treating. However, the carbon particles in the pitch are detrimental to use of the pitch as an impregnating agent or as a precursor for producing carbon fibers.

U.S. Pat. No. 3,673,077 by Roza discloses producing both carbon black feedstock and binder pitch. A slurry oil feed or feed of ethylene cracker bottoms is thermally soaked, apparently in a batch operation, for 24 minutes to 26 hours at 370° C. to 450° C. The ring and ball softening points of the pitches produced ranged from 92° C. to 102° C. It is not clear from the patent what the yields were based on slurry oil feed to the process. A typical feed with boiling range of 250° C.-350° C. was "thermally cracked" sometimes with steam and/or air addition to yield a cracked product which was fractionated to recover a residual fraction boiling above about 330° C. Phrased another way, the process began with a distilled feed that was then thermally cracked and thermally polymerized. Some products were lighter and some heavier than the feed. Fractionation was used to recover anything boiling in the feed range that was presumably recycled. The residual fraction was thermally polymerized material with a higher boiling point than the feed. If the process achieved yields similar to coking, at least ⅔ of the reactor feed would be recovered overhead and less than ⅓ recovered as a residual fraction. Yields of pitch from the residual fraction were reported at up to 55.9% wt., but this is not based on fresh feed, rather it was the yield obtained from the residual fraction, the ≥330° C. product. Most of the 250° C.-350° C. feed, and the cracked products thereof, were removed overhead during fractionation of the thermally cracked product, so yields of pitch based on fresh feed are probably in the 10%-20% range, based on fresh feed. The pitch product had a softening point of 92° C.

U.S. Pat. No. 3,318,801 by Alexander discloses thermal treatment of ethylene cracker bottoms at pressures no higher than 250 psig and generally less than 100 psig. Some of the examples operated at thermal soaking temperatures of 357° C. (675° F.) to 396° C. (745° F.) with residence times of more than one hour. The highest softening point reported for the pitches produced was 95° C. (203° F.). One example used a thermal soaking temperature of 455° C. (850° F.) and residence time of approximately one minute. The softening point of the pitch produced was 81° C. (178° F.). The last example required distillation of the thermal soaker product to produce the pitch product. The pitch yield was 30% of the charge material.

U.S. Pat. No. 3,140,248 by Bell discloses multi-step thermal treatment of slurry oil to make pitch. The slurry oil and 2 to 8 volumes of a recycled gas oil boiling range material are thermally cracked at 850°-1050° F. to produce a thermally cracked stream which is quenched. This quenched stream, mostly gas oil boiling range material by weight, is fractionated to recover and recycle a "thermal gas oil" as an overhead product and a first stage product, a residual product, and a "thermal asphalt" fraction with a softening point of 130° to 180° F. This "thermal asphalt" was then given a second stage of processing. It was heat soaked at 900° to 1100° F. and 30 to 700 psig for 4 to 20 minutes to make pitch product. After heat soaking, a vacuum tower separated product pitch from the gas oil. Multiple step processing of the feed, and the need to recycle so much of the first stage effluent added significantly to the cost of capital and operations. Furthermore, the bottoms product from this first stage was not the desired product.

One process used the tendency of thermal polymerization to produce both isotropic and mesophase pitch and took steps to produce both types of pitch, or at least precursors of both types of pitch, and to separate the precursors to facilitate later production of two pure pitch products. U.S. Pat. No. 4,925,547 by Tsuchitani taught a multistep process for making both isotropic and mesophase pitch. The examples started with coal tar thermally treated in a tubular reactor immersed in a salt bath to produce an unstable product, perhaps something like a severely visbroken product. The liquid product separated to some extent. It was solvent extracted, using xylene to produce a solvent or extract phase which after solvent recovery and significant additional heat treating produced isotropic pitch in a yield of 7-14 wt % of fresh feed. The sediment or fraction rejected by solvent treating was a heavy oil which required significant thermal treatment to produce mesophase pitch.

If one wanted to use the above process to make isotropic pitch, it would be necessary to have a first stage of thermal processing to make a liquid phase product with some sediment or other phase instability, solvent extract the liquid phase, remove solvent from the extract, heat treat the soluble portion, then flash and fractionate to make pitch. Yields of pitch based on fresh feed were relatively low. Such an approach and many more reported in the patent literature would make isotropic pitch, but the approach was complex and the yields were low.

A disadvantage of all of the processes described above is that the yields per pass of pitch from the feedstocks are low. This increases the volume and cost of heating the reactor charge. More significantly, the recovery and reuse of large volumes of byproducts or unconverted feed is required to make the process viable. Fractionation is costly when relatively large amounts of light materials such as naphtha boiling range or light distillate materials must be removed from heavy distillate materials being recycled to the pitch heater. It is relatively easy to separate pitch which is a non-distillable material from gas oil and lighter materials, but much more work is required to separate, e.g., naphtha fractions from gas oil fractions. It is important, however, to remove the light material from recycled gas oil as the recycle of gasoline boiling range material would vaporize in the heater or soaking zone and effectively reduce the pressure and the pitch yield of the process.

It is easy to flash pretty much any distillable material from non-distillable pitch in a single simple flash drum, perhaps operated under vacuum or with some steam injection to aid stripping. Such a flash drum is low cost and functions as a reliable one stage distillation column. When pitch manufacturers have to separate a relatively small amount of naphtha from a large amount of recycle gas oil fraction and then have to recycle a large amount of gas oil to convert some of it to pitch, capital and operating costs multiply. Many refiners would like to be able to recover pitch product downstream of the thermal reactors using a simple flash drum, and recover a recycle gas oil fraction by simply condensing vapors from the flash drum, but no one has been able to do so. Invariably too much naphtha is made and fractionation is required to avoid undue loss of distillate in the naphtha fraction.

Another fundamental challenge in producing highly aromatic pitch is operating at temperatures and residence times to maximize the yield of isotropic pitch without producing significant coke or mesophase. If the time and temperature are low, conversion rates are low, resulting in low yields. If the time and temperature are too high, coke can form, clogging equipment and/or producing pitch contaminated with coke particles. If conditions are severe, some mesophase can form and this is a contaminant when isotropic pitch is the desired product.

We wanted a better pitch process, one which could quickly and simply convert a thermally polymerizable feed into isotropic pitch. Especially troubling was the low "productivity" of current continuous pitch processes, with low conversions of reactor feed per pass through the reactor, typically on the order of 10-15%, and always less than 20%. Another concern, in addition to the amount of material that had to be recycled, was the amount of work required to clean up the recycle material by removing lighter fractions such as naphtha. Recycling unconverted material is not too expensive if it can be recaptured in a readily recyclable form. The low conversion to pitch in prior art processes seemed to be accompanied by relatively high conversion to naphtha. Not only was significant recycling required, but significant fractionation of the recycle material was needed as well.

We did extensive experimental work. We used a coiled tube reactor and relatively high velocities in the tube and developed a better way to heat the tubular reactor, largely eliminating "hot spots". This allowed us to run at somewhat higher temperatures without forming coke on a localized hot metal surface. All known prior art continuous processes used relatively mild conditions, i.e., they operated with conditions so mild that conversion of the feed was limited. For a process to be economically viable, significant amounts of unconverted, or only partially converted, feed had to be recovered and recycled. If less than 20 wt % of the feed was converted per pass, much work was required to recover the >80% of the feed which was unconverted. The plant had to be sized to handle a relatively large stream because of low conversion per pass.

The prior art believed that to limit fouling of heater tubes or formation of undesired mesophase typically only a modest portion of the feed could be converted per pass. The prior art generally converted an aromatic rich feed into pitch using a two step process. First, a fairly vigorous thermal treatment in a fired heater usually at a moderate pressure was followed by quenching and separation of some of the lighter products of thermal cracking from a thermal tar. Then an additional step, or steps, converted the thermal tar into pitch.

In the Bell patent, U.S. Pat. No. 3,140,248, discussed above, the feed was first thermally cracked in a coil at 940° F., 400 psig coil outlet pressure. The thermally cracked oil after removal of gasoline and lighter material contained significant pitch, but the softening point was only 110° F. or so. This thermal tar perhaps mixed with additional gas oil diluent was next given a lengthy and lower pressure thermal soaking treatment, 10 minutes, at 970° F., 120 psig, to produce a material which could be fractionated to yield a pitch with a softening point of 230° F. Two stages of processing were required. The first stage made a thermal tar, the second made a pitch product. Yields on (fresh+recycle) feed were 19.175 wt %, or 76.7 yield of pitch on fresh feed, with a 3:1 recycle ratio.

Tsuchitani, U.S. Pat. No. 4,925,547, taught a multi-step process to make isotropic pitch. The first stage, at about 300 psia in a small tubular reactor made a heavy oil, with some settling. The oil was given an extraction treatment. The extract phase was fractionated to remove solvent, then given additional thermal treatment to produce isotropic pitch, but yields were less than 20 wt % based on fresh feed. The settlings or reject phase was given additional treatments to produce mesophase.

In addition to concerns about coking or making isotropic pitch with contaminating mesophase, there are more constraints on the isotropic pitch product. For many premium uses, coking value is important. As would be expected, there is a relationship between softening point and coking value. Material with a low softening point has a low coking value since much of the "pitch" is oil. The target for many petroleum pitches with a softening point of 230-240° F. is a coking value of 50. For some uses a higher coking value of about 55 is needed. For reasons that are not completely understood, coal tar pitch has a significantly higher coking value than a similar softening point petroleum pitch. The higher coking value of coal tar pitch is modest, usually an increase of 5 or so in coking value, but the slightly higher coking value of coal tar pitch is important enough that for many applications petroleum pitch is not used commercially.

In U.S. Pat. No. 6,352,637 by Doolin et al, the problem of low coking value in petroleum pitch was addressed. The patentees recognized that in the aluminum industry, petroleum pitch was rarely used. The primary reason was the significantly higher coking value of coal tar pitch. The coking value of petroleum pitch was improved to some extent by fractionating the petroleum pitch to a high softening point and then adding a solvent, to produce a pitch with a given softening point and somewhat higher coking value than the starting pitch.

Table 1 from the patent is abstracted below, to show coking values of commercially available petroleum pitch.

TABLE 1

Specifications and Typical Properties of Marathon Ashland Petroleum Pitch CAS Number 68334-31-6

| Analysis | Test Method | A170 Pitch | A240 Pitch | A225 Pitch |
|---|---|---|---|---|
| Softening Point, Mettler ° C. | ASTM D3104 | 79.4-82.6 | 118-124 | 105-110 |
| Softening Point, ° F. | D36 | 200 | 270 | 260 |
| Coking Value, Modified Conradson Carbon | ASTM D2416 | NA | 49 | 46 |

In Doolin, et al., pitch was distilled in a wiped film evaporator to a high softening point, then cut back to a lower softening point with solvent to produce a petroleum pitch with a coking value closer to coal tar pitch. Such an approach works, but wiped film evaporators are expensive to buy and operate and have relatively low capacity.

We wanted a better pitch process. The Bell patent pretty much represents the "state of the art"—pitch was made by thermal polymerization, very cautiously. A two step process was used with low conversion per pass. Fractionation was needed to make pitch product with a softening point above that of boiling water. Our goal was for a simple and reliable process which could make pitch of acceptable quality in a single step. We knew some recycle would be needed, but we wanted to reduce the amount of recycle required for a viable process. We especially wanted to simplify whatever recycling was needed and do so by flashing and selectively condensing reactor effluent, thus avoiding fractionating the recycle material. We hoped to improve the coking value of petroleum pitch and make a plant that would operate without coking up and shutting down. Our plant also would produce isotropic pitch product not contaminated with mesophase.

We started work with a tubular reactor and used electricity to heat the metal uniformly. We obtained promising results, but had plugging problems. Uniform heating helped us go to higher temperatures than could be done in a fired heater because we did not have "hot spots", but we still had some coke formation.

Almost a year of work in the laboratory could be condensed down to a few key tests that we ran during the year, not always appreciating the significance of a run until some time after the run. Our first tests were done in a 37.5 foot tubular reactor. The process worked fairly well with a 900 psig outlet and 940° F. temperature. We achieved significant conversion per pass but there was still some coke formation and product purity was not as high as desired in that there was usually some mesophase pitch present in and contaminating the isotropic pitch product. We were able to get relatively high conversion, higher than anything reported or known in the prior art but had trouble getting an acceptable run length, due to coking or fouling of the tubular reactor, at times exacerbated by equipment failures.

We switched to a longer tubular reactor—250 feet. More residence time in the thermal reactor would permit use of lower temperatures or steam addition, discussed next. Steam is reactive at the temperatures used and might react with intermediate reaction products or even coke as it was formed permitting longer run lengths.

We tried one run with the longer reactor maintaining the pressure and temperature previously used, with 10 wt % steam addition. We thought that the steam would move fluid through the tubing vigorously and perhaps react with coke as it formed and improve the process. Our estimate was that liquid residence time in the longer reactor would be about the same as using the 37.5 ft reactor, with the longer tube length offset by steam addition.

This run with steam produced an awful product. There was 12.5 wt % mesophase in the isotropic pitch. This was an intolerable amount of mesophase for an isotropic pitch product. We had thought steam would help by increasing velocity or perhaps being a reactant, but found that steam hurt the process in some way, perhaps by creating a pseudo vacuum reducing the effective pressure and reducing the amount of the feed that was in liquid phase.

Then we tried another run in the longer reactor with a completely dry feed. We kept the outlet pressure and the temperature the same as in previous runs, but increased the feed rate to keep the residence time the same. To our surprise, we converted most of the feed to pitch product and the mesophase content of the isotropic pitch product was about 0.1 wt %. Although we had significant conversion of feed to pitch, there was relatively low yield of gasoline boiling range material, and the gasoline appeared to be highly aliphatic—lower in olefin content than any gasoline fraction produced by any prior thermal process whether mild visbreaking or severe coking.

Our gasoline production was small. This new gasoline fraction was valuable as a blending stock or one which could be easily treated in a conventional low pressure hydrotreater, but the small amount precluded it being a major factor in the economics of our process in terms of something to sell. These results did permit a significant simplification of the plant and a reduction in operating costs. The amount of gasoline and lighter material produced was so small that it was possible to use a simple flash drum for initial separation of pitch product from gas oil and lighter boiling range material. The gas oil boiling range vapor phase could be selectively condensed, leaving a gasoline rich and lighter vapor phase.

There was enough gasoline boiling range material in our process and in all prior art processes that it would be harmful to the process to simply recycle a gas oil stream containing large amounts of readily vaporizable material such as gasoline. In the prior art, the recycled distillate boiling range material was always fractionated to remove gasoline, light distillate, and the like from the gas oil boiling range hydrocarbons being recycled. In our process, the amount of gasoline in the vapor phase recovered from the pitch flash drum was so small that simple condensation of this vapor phase could be used to recover a gas oil boiling range recycle stream with a tolerable content of light ends such as gasoline. Of course such a simple condensing step could achieve only a crude separation or fractionation of gasoline from a much larger gas oil fraction. The gasoline fraction in our process was so small that the loss of some distillate to the gasoline vapor fraction could be tolerated. Our improvement was not a new way of running a flash pot or condenser since the use of a flash and condenser achieved fractionation approaching one theoretical distillation tray. The improvement was running the pitch process to produce so little gasoline that this sloppy fractionation was tolerable. There was so little gasoline produced, it did not matter if it had some gas oil boiling range materials in it.

The gasoline fraction by its small volume and unusual aliphatic character was also a "marker" that something different was going on in our process. Our process required high temperatures and sufficient residence time to make pitch, but did not make unstable gasoline.

We realized that there were several key factors to making the process work in a single stage which was one of our goals.

We needed high velocities in the tube. We needed to have a dry feed since steam degraded the product. Temperatures were high, and residence time was low. Pressure had to be high because most of the feed and most of the interim reaction products had to remain in liquid phase. With these carefully selected parameters, we were able to do something that had not been done before—take an aromatic oil feed that was a liquid, perhaps a viscous liquid, and convert it into a pitch product in a single stage. We had the option to recycle the unconverted gas oil boiling range material in the reactor effluent using a simple flash and condensation step rather than distillation.

We operated the process with sufficient thermal severity to achieve per pass conversions sufficiently high that we could merely "flash" the material discharged from the tubular reactor to produce a bottoms product pitch that was adequate for many purposes. The threshold lower limit of conversion to achieve this flash separation was about 20 wt % conversion per pass, but we have achieved conversions approaching 50 wt % per pass. Such high conversions and severe thermal conditions allowed the tubular reactor effluent to have enough energy in it to flash off everything that was not pitch. In contrast, prior art pitch processes limited conversion, per pass to such an extent that the reactor effluent was too dilute to "flash". Fractionation was required to make a pitch product with a softening point above 80° to 100° C.

High conversion per pass was a necessary part of our process, but from our failed experiments with steam injection we learned that high pressure, high temperature and high tube velocities were not enough to ensure that a salable pitch product could be made. To suppress mesophase formation, we had to avoid having a significant vapor phase. Steam addition led to mesophase formation. To suppress mesophase, we omitted the steam, effectively increasing the pressure in the tubular reactor and the percentage of material in the liquid phase. Phrased another way, we kept the pressure high enough to suppress mesophase formation and avoided charging steam, light ends or readily vaporizable materials to the tubular reactor.

BRIEF SUMMARY OF THE INVENTION

Accordingly, in one embodiment the present invention provides a process for producing isotropic pitch comprising charging a feed comprising distillate boiling range aromatic rich liquid and an optional distillate boiling range recycle material to an inlet of a tubular or pipe reactor and heating said feed within said reactor at a temperature sufficiently high to induce thermal polymerization of said feed and a pressure sufficient to maintain at least a majority by weight of said feed in liquid phase, and passing said feed through said reactor for a time sufficient to convert at least a portion of said feed to isotropic pitch and gasoline boiling range material, discharging from said reactor an effluent stream comprising pitch product and byproducts, and recovering isotropic pitch as a product of the process and wherein the time and temperature in said reactor create thermal conditions sufficient to convert at least 20 wt % of said feed and any recycle material which may be present and said pressure is sufficiently high to suppress mesophase formation.

In another embodiment the present invention provides a method of converting slurry oil into isotropic pitch, comprising charging a feed comprising slurry oil having a boiling range, at a temperature above 900° F. to a tubular or pipe reactor and passing said feed through said reactor at a velocity of at least 1 m/s for a time sufficient to convert at least 20 wt % of said feed to a pitch product, unconverted or only partially converted material boiling within the same boiling range as the feed and lighter materials produced as a result of thermal cracking, thermal dealkylation, or thermally induced polymerization of said feed, and wherein a pressure in said reactor is maintained above 500 psig and sufficient to suppress mesophase formation to a predetermined amount in said isotropic pitch product; discharging into a flash drum operating at a pressure less than $1/10^{th}$ said pressure in said reactor said pitch, said unconverted or partially converted feed and said lighter material; flashing from said flash drum a vapor phase comprising said unconverted or partially converted feed and said lighter material from a residual liquid phase comprising said isotropic pitch; cooling said vapor phase removed from said flash drum sufficiently to condense at least a majority by weight of said unconverted or partially converted feed, charging said cooled vapor phase into a separation vessel and separating therein a liquid phase comprising said unconverted or partially converted hydrocarbons and a vapor phase comprising at least a majority, by volume, of said lighter material, and removing from said separation vessel and recycling said liquid phase to a reactor and removing a vapor phase comprising said lighter material.

In yet another embodiment the present invention provides a process for thermally polymerizing an aromatic rich liquid obtained as a heavy product from the fluidized catalytic cracking process to produce isotropic pitch comprising charging a slurry oil, clarified slurry oil, or filtered slurry oil feed to a tubular or pipe reactor having an inlet and an outlet and passing said feed through said reactor at thermal polymerization conditions including a temperature above 900° F., an average liquid velocity of at least 1 m/s, and outlet pressure of at least 500 psig to produce a reactor effluent comprising thermally polymerized isotropic pitch, unconverted feed or partially polymerized material and lighter liquid products having a lower boiling point than said feed and comprising gasoline boiling range materials and normally gaseous products; discharging said reactor effluent into a flash drum operated at a pressure from sub-atmospheric to 50 psig and flashing therein said effluent to produce a liquid phase comprising isotropic pitch having a softening point above 80° C. and a vapor phase comprising unconverted or partially converted feed, gasoline boiling range material, and normally gaseous hydrocarbons; removing from said flash drum said liquid phase comprising isotropic pitch as a product of the process and a flash drum vapor phase; cooling said flash drum vapor phase at a temperature and pressure sufficient to condense at least a majority by weight of said unconverted or partially converted feed and produce a flash drum cooled vapor phase and condensed liquid phase which is charged to a vapor liquid separator; separating in said vapor liquid separator said cooled vapor and condensed liquid and withdrawing a liquid phase containing a majority of said unconverted or partially converted feed and a vapor phase comprising at least a majority by weight of said gasoline boiling range components; and analyzing at least periodically said isotropic pitch product for mesophase content and maintaining said pressure sufficiently high to suppress mesophase formation in said reactor and reduce mesophase contamination of said isotropic pitch product to a predetermined level below 1 wt %.

In another embodiment the present invention provides a high conversion, continuous process for making a flashable isotropic pitch product from a thermally polymerizable multi-ring aromatic feedstock comprising fractionating a feedstock to remove, or selecting a feedstock having removed there from essentially all gasoline and lighter boiling range materials from a normally liquid hydrocarbon feed comprising multi-ring aromatic hydrocarbons to produce a pitch feedstock having a boiling range; charging said pitch feedstock to an inlet of a tubular or pipe reactor having an inlet and an outlet; thermally polymerizing, at thermal polymerization conditions including temperature, pressure and residence time, said pitch feedstock in said reactor at a temperature sufficiently high to thermally crack or thermally dealkylate a minor portion of said pitch feedstock to produce gasoline and lighter boiling range materials and wherein said temperature is also sufficiently high to thermally polymerize said pitch feedstock to isotropic pitch, to mesophase pitch and to coke; maintaining a pressure in said reactor sufficiently high to suppress mesophase formation to a predetermined level which is compatible with an isotropic pitch product and to suppress coke formation; discharging from said reactor a reactor effluent comprising gasoline and lighter boiling range materials, unconverted or partially converted feed boiling within the same range as said pitch feedstock and isotropic pitch; and maintaining time and temperature in said reactor sufficiently high to convert a predetermined amount of said pitch feed to isotropic pitch and maintaining the temperature of the reactor effluent sufficiently high and the pressure of the flash zone sufficiently low that essentially all of the gasoline and lighter material and at least a majority of said unconverted or partially converted pitch feedstock flashes off as a flash vapor from a liquid phase containing said isotropic pitch product which is withdrawn from said flash zone as a liquid phase pitch product.

A process for converting a gas oil and heavier aromatic liquid feedstock comprising alkyl aromatic hydrocarbons, multi-ring aromatic hydrocarbons and having a boiling range into a gasoline fraction by thermal dealkylation, and isotropic pitch, by thermal polymerization, comprising charging said feedstock to an inlet of a tubular or pipe reactor having an inlet and outlet; thermally polymerizing, at thermal polymerization conditions including temperature, pressure and residence time, said feedstock in said reactor at a temperature sufficiently high to thermally crack or thermally dealkylate at least a portion of said alkyl aromatics in said feedstock to produce gasoline and lighter boiling range materials and wherein said temperature is also sufficiently high to thermally polymerize at least a portion of said feedstock to isotropic pitch, to mesophase pitch and to coke; maintaining the pressure in said reactor sufficiently high to suppress mesophase formation to a predetermined level which is compatible with an isotropic pitch product and to suppress coke formation; discharging from said reactor, a reactor effluent comprising gasoline and lighter boiling range materials, unconverted or partially converted feedstock boiling within the same range as said feedstock, and isotropic pitch; maintaining time and temperature in said reactor sufficiently high to convert a predetermined amount of said feedstock to isotropic pitch and maintaining said pressure within said reactor sufficiently high to force at least a portion of thermally cracked materials to be dissolved within liquid in said reactor and at least a portion of this dissolved, cracked material to react with material in said liquid phase of said reactor to form isotropic pitch, and discharging from said reactor a stream comprising gasoline and lighter material, unconverted or partially converted feedstock boiling within the boiling range of said feedstock, and isotropic pitch and wherein at least an order of magnitude more isotropic pitch is produced than gasoline on a weight basis.

DRAWINGS

Figures

Figure 1:
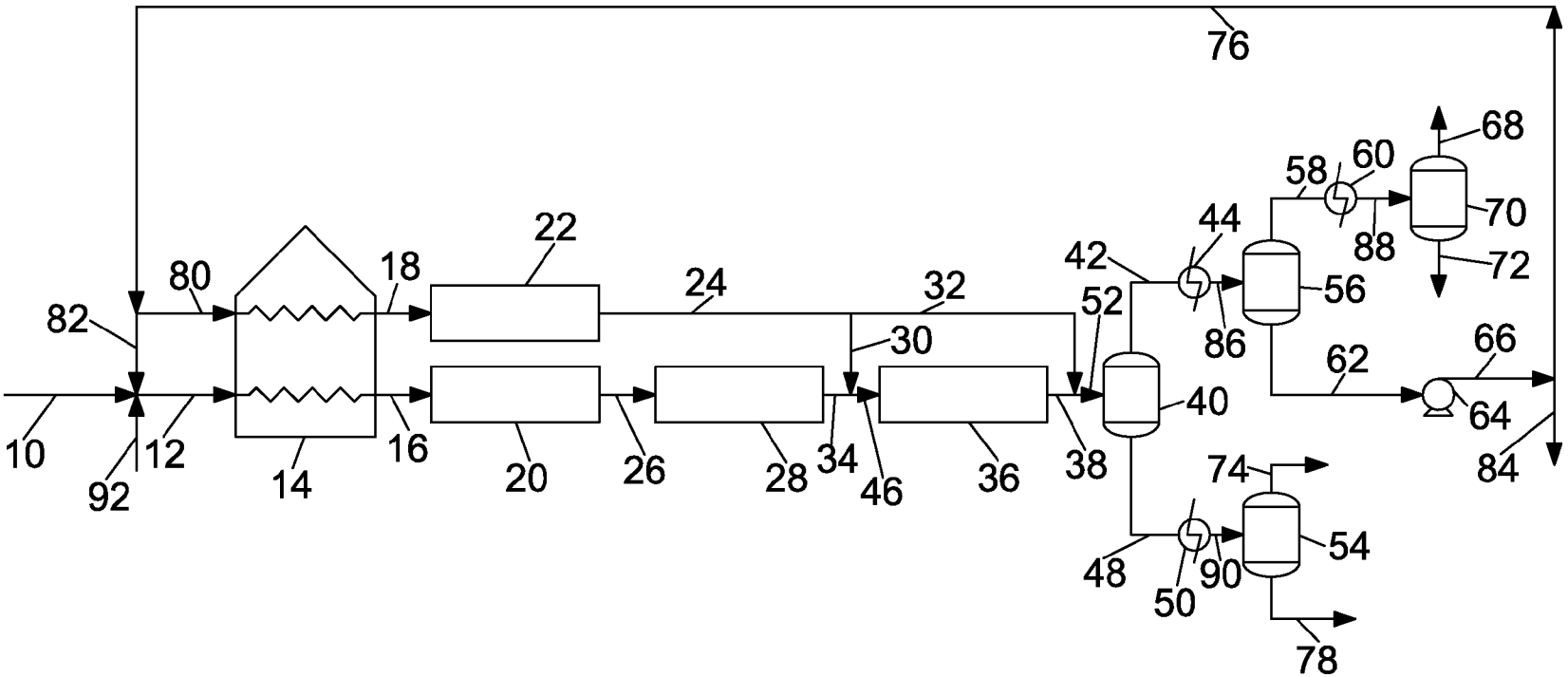
FIG. 1 illustrates a schematic of an embodiment of the process.
Figure 2:
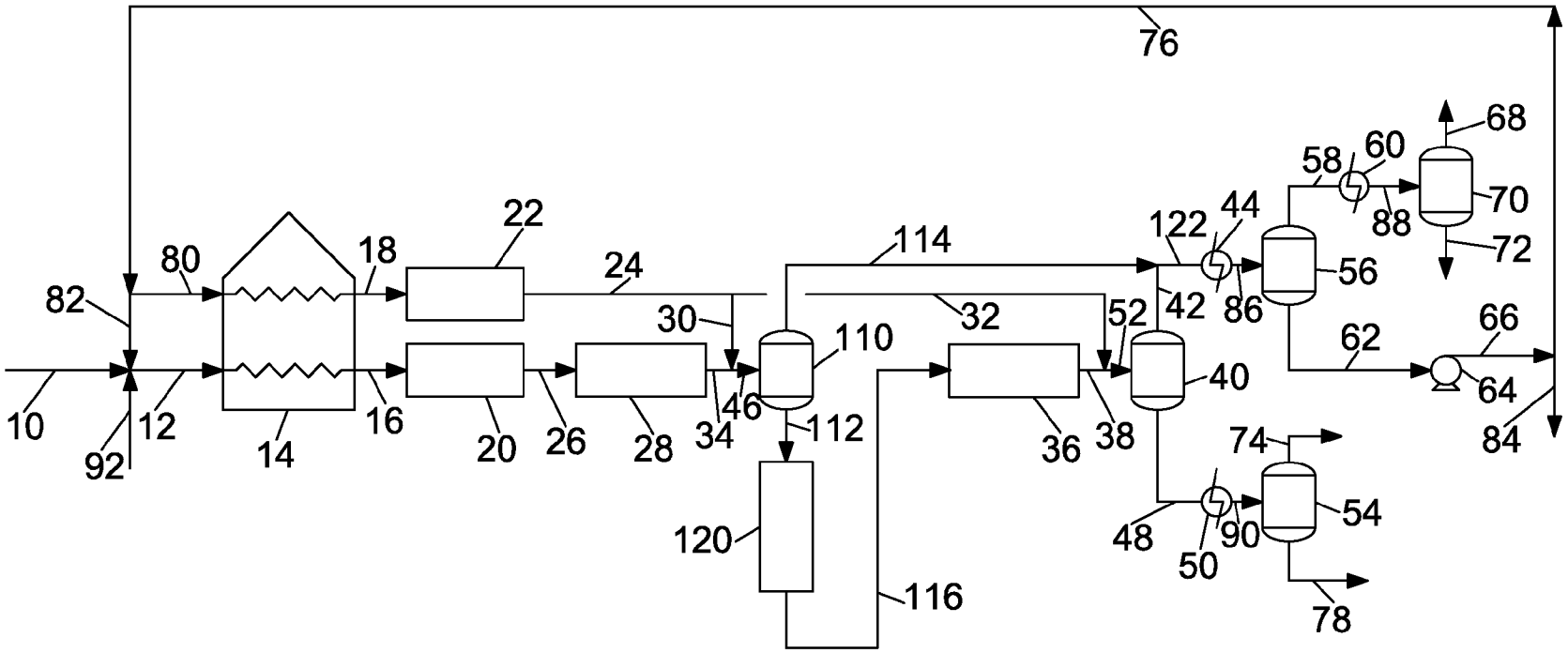
FIG. 2 illustrates a similar schematic of an embodiment of the process that has an additional liquid vapor separator to reduce vaporization, to reduce the degree of vaporization and to improve the control of product properties in downstream equipment.
Figure 3:
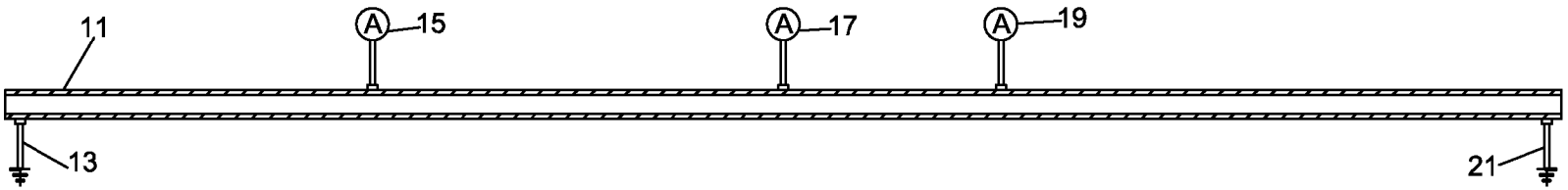
FIG. 3 illustrates an embodiment of heating equipment to precisely control the temperature of fluids flowing in a conduit.
Figure 4:
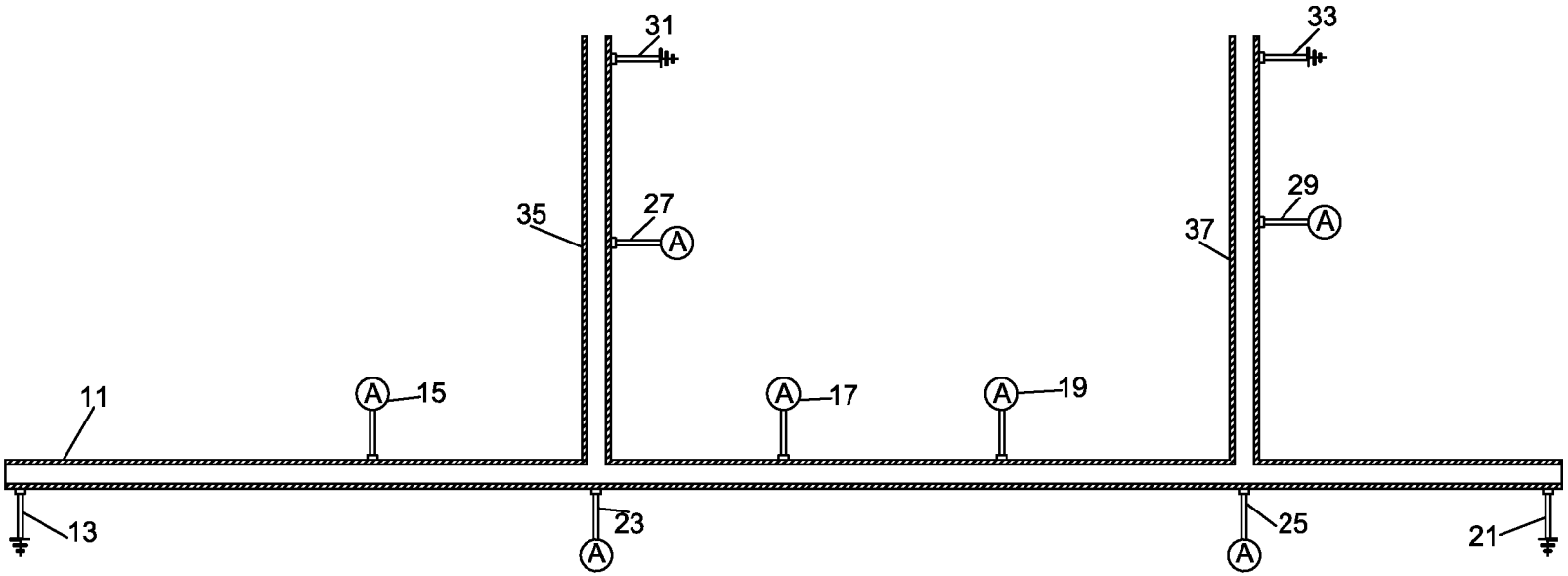
FIG. 4 illustrates an additional embodiment of the equipment described in FIG. 3.

| DRAWINGS - REFERENCE NUMERALS | |
|---|---|
| For FIGS. 1 and 2 | |
| 10 feed stream | 12 combined feed and recycle |
| 14 fired heater | 16 partially heated feed |
| 18 partially heated recycle | 20 first precision heater |
| 22 second precision heater | 24 recycle at reaction temperature |
| 26 feed at reaction temperature | 28 first zone of thermal reaction |
| 30 intermediate recycle | 32 final recycle |
| 34 outlet of first reaction zone | 36 second zone of thermal reaction |
| 38 outlet of second reaction zone | 40 first liquid-vapor separator vessel |
| 42 vapor from first separator vessel | 44 first vapor partial condenser |
| 46 combined inlet to second reactor | 48 liquid from first separator vessel |
| 50 liquid cooler from first separator | 52 combined inlet to first vessel |
| 54 second liquid-vapor separator vessel | 56 third liquid-vapor separator |
| 58 vapor from third liquid-vapor separator | 60 second vapor partial condenser |
| 62 liquid from third separator | 64 recycle pump |
| 66 discharge from recycle pump | 68 fuel gas from fourth separator |
| 70 fourth separator vessel | 72 light liquid from fourth separator |
| 74 vapor from second separator | 76 total recycle stream |
| 78 product pitch | 80 recycle to fired heater |
| 82 recycle to fresh feed | 84 distillate product |
| 86 inlet to second vessel | 88 inlet to third vessel |
| 90 inlet to fourth vessel | 92 water or steam injection |
| For FIG. 2 only | |
| 110 fifth separator vessel | 112 liquid from fifth separator vessel |
| 114 vapor from fifth separator vessel | 116 liquid from third precision heater |
| 120 third precision heater | 122 combined vapor stream to cooler |
| For FIGS. 3 and 4 | |
| 11 process conduit | 13 first electrical ground |
| 15 first current source | 17 second current source |
| 19 third current source | 21 second electrical ground |
| For FIG. 4 only | |
| 23 fourth current source | 25 fifth current source |
| 27 sixth current source | 29 seventh current source |
| 31 third electrical ground | 33 fourth electrical ground |
| 35 first recycle conduit | 37 second recycle conduit |

DETAILED DESCRIPTION OF PREFERRED EMBODIMENTS

FIG. 1 illustrates one embodiment of the process. FIG. 2 illustrates a second embodiment of the process. FIG. 3 illustrates a means to achieve precise, uniform temperature control of the process fluid. FIG. 4 illustrates a second embodiment of the device in FIG. 3. FIG. 1 and FIG. 2 are very nearly identical with the exception of an additional processing step in FIG. 2. The reference numerals in FIG. 1 and FIG. 2 are identical for corresponding equipment. The following description will describe either embodiment with noted exceptions where differences exist. Similarly FIGS. 3 and 4 are very similar. Common reference numerals in these figures refer to identical items. The description of FIG. 4 will consider only the additional features in FIG. 4 that are not in FIG. 3.

Fresh feed 10 mixes with distillate recycle 82 and optionally water or steam injection 92 to comprise one fired heater inlet stream 12. Normally steam or water will not be added to the feed, as in some experiments discussed hereafter, steam addition caused significant mesophase production. It may still be beneficial to have some way of getting steam into the tubular reactor, to de-coke during some periods of operation should coke build up during normal operation or during an upset. Some distillate recycle 80 may be heated separately in the fired heater 14. The fired heater outlet temperature is 5° to 25° C. below the reaction temperature. The heater outlet streams 16 and 18 are heated to reaction temperature by precision heaters 20 and 22. The outlet from the first precision heater 20 enters via line 26 a high shear precision temperature controlled reactor 28. Some of the heated recycle material may be charged via line 24 and line 30 to combine with the outlet of the first reactor in line 34 to and charged via inlet 46 to the second high shear precision temperature controlled reactor 36. Some of the heated recycle material may pass via line 32 to combine with the outlet of the second reactor 38 to become the inlet 52 to a high, pressure high temperature flash vessel 40.

Hot, high-pressure vapor 42 from flash vessel 40 is cooled by a heat exchanger 44 to an intermediate temperature stream 86. Second flash vessel 56 separates stream 86 into a vapor 58 and a liquid stream 62. Recycle pump 64 discharge 66 may be recycled as stream 76 or withdrawn as product 84. The pressure of stream 58 is reduced to a pressure appropriate for a fuel gas system and is further cooled by heat exchanger 60 to produce the inlet 88 to a third flash vessel 70. Vapor 68 from the third flash is either further treated for use as fuel gas or burned in a flare. A light liquid stream 72 is withdrawn as a product stream.

Hot, high-pressure liquid 48 from flash vessel 40 is throttled to a pressure appropriate for a fuel gas system and cooled to an intermediate temperature by heat exchanger 50 to become the inlet 90 to a fourth flash vessel 54. The vapor 74 should be combined with the vapor 68 from the third flash vessel 70. The liquid 78 from the fourth flash vessel 54 is withdrawn as a pitch product.

FIG. 2 is identical to FIG. 1 except that the outlet 34 of the first reactor 28 combined with the distillate recycle 30 to form 46 flows to a fifth flash vessel 110. The vapor outlet 114 combines with vapor stream 42 to form stream 122 the inlet to heat exchanger 44, previously described.

Liquid 112 from the fifth flash vessel 110 will be heated if needed in a precision heater means 120. The outlet 116 of heater 120 enters the second reactor 36 as stream 46 did in the description for FIG. 1. The purpose of this embodiment is to reduce the amount of vapor in the reactor system. A third embodiment of this process uses multiple instances of vessels such as the fifth flash vessel 110 and multiple reactor means such as reactor 36 to further reduce the amount of vapor in the reactor system.

FIG. 3 illustrates a preferred embodiment using a particular precision temperature heater and/or reactor means for very accurately and uniformly controlling the temperature of a fluid being heated and/or reacted. A standard pipe or tube 11 of the appropriate metallurgy (for these conditions Austenitic stainless steel), thickness, internal diameter and length is a flow conduit for the various streams heated or reacted in FIGS. 1 and 2. Current sources 15, 17 and 19 add or withdraw current to or from the walls of conduit 11. Electrical ground connections 13 and 21 ensure that no significant electrical current flows to other parts of the process. Electrical current passing through the length of the conduit wall produces heat proportional to the resistance of the conduit wall. No other electrical effect such as inductive coupling is intended. One embodiment of this device uses direct current, DC as opposed to alternating current, AC. While AC will provide nearly identical resistance heating capabilities as DC, it may induce currents in unwanted equipment such as instruments and other electrically conductive materials. DC minimizes this effect.

As electrical current may flow into or out of the conduit walls 11 through the current sources 15, 17 and 19 it should be apparent to those skilled in the art that the section between current source 15 and the ground connection 13, could be the precision heater described earlier. Similarly the section between current source 15 and current source 17 could be the first reactor. The section between current source 17 and current source 19 could be the second reactor. The section between current source 19 and ground connection 21 could be a third reactor.

A third embodiment of this device uses a coiled conduit 11. The coils are sufficiently separated and electrically insulated such that there is no short-circuiting between the coils or to unintended electrical grounds. A coiled arrangement allows for a compact reactor system for long conduit 11 lengths especially for conduit 11 outside diameters less than 25 mm.

A fourth embodiment of this device uses straight lengths of conduit 11 with 180° return bends. The plane passing through the straight lengths of conduit can be vertical, horizontal or something intermediate. This arrangement also allows for a compact reactor system for long conduit 11 lengths especially for conduit 11 outside diameters greater than 50 mm.

A fifth embodiment of this device is illustrated in FIG. 4. Provisions for additional recycle stream conduits 35 and 37 have been added to the device of FIG. 3. Additional electrical current sources 23, 25, 27 and 29 have been added. Additional electrical grounds 31 and 33 have been added so that no significant electrical current flows outside the intended heating equipment. It should be noted that all current sources might either add or remove current such that any of the current sources could be an electrical ground. It should also be noted that the conduits 11, 35 and 39 could be of any length. The intended direction of fluid flow is from left to right for conduit 11 and from top to bottom for conduits 35 and 37. Further, the conduits 11, 35 and 37 could be coiled, fitted with return bends or otherwise configured so that long sections of conduit could be accommodated in a compact space. Finally it should be noted that an additional number of conduits similar to conduits 35 and 37 could be used as needed.

Precision heater means and reactor temperature control means other than that described above could be used in the process described in FIGS. 1 and 2. For example skin effect induction could be used in place of the heaters and temperature controlled reactors described above.

Discussion

Production of highly aromatic pitch (HAP) is a chemically complex process. It is believed that the general types of chemical reactions that take place in pitch production fall into two broad groups. The first type of reaction is dealkylation and/or dehydrogenation. The preferred feedstocks for producing HAP are typically alkyl-substituted aromatics of at least 2 condensed rings and preferably more than two rings.

The methyl group most is the most predominate alkyl group found on these condensed rings. The degree of ethyl substitution is typically much less than the degree of methyl substitution. The degree of propyl substitution is typically much less than the degree of ethyl substitution and there are virtually no substituent groups heavier than propyl. Dealkylation and/or dehydrogenation of these rings under the conditions described herein are thermal reactions. These reactions are prohibitively slow below 400° C.

Figure 5:
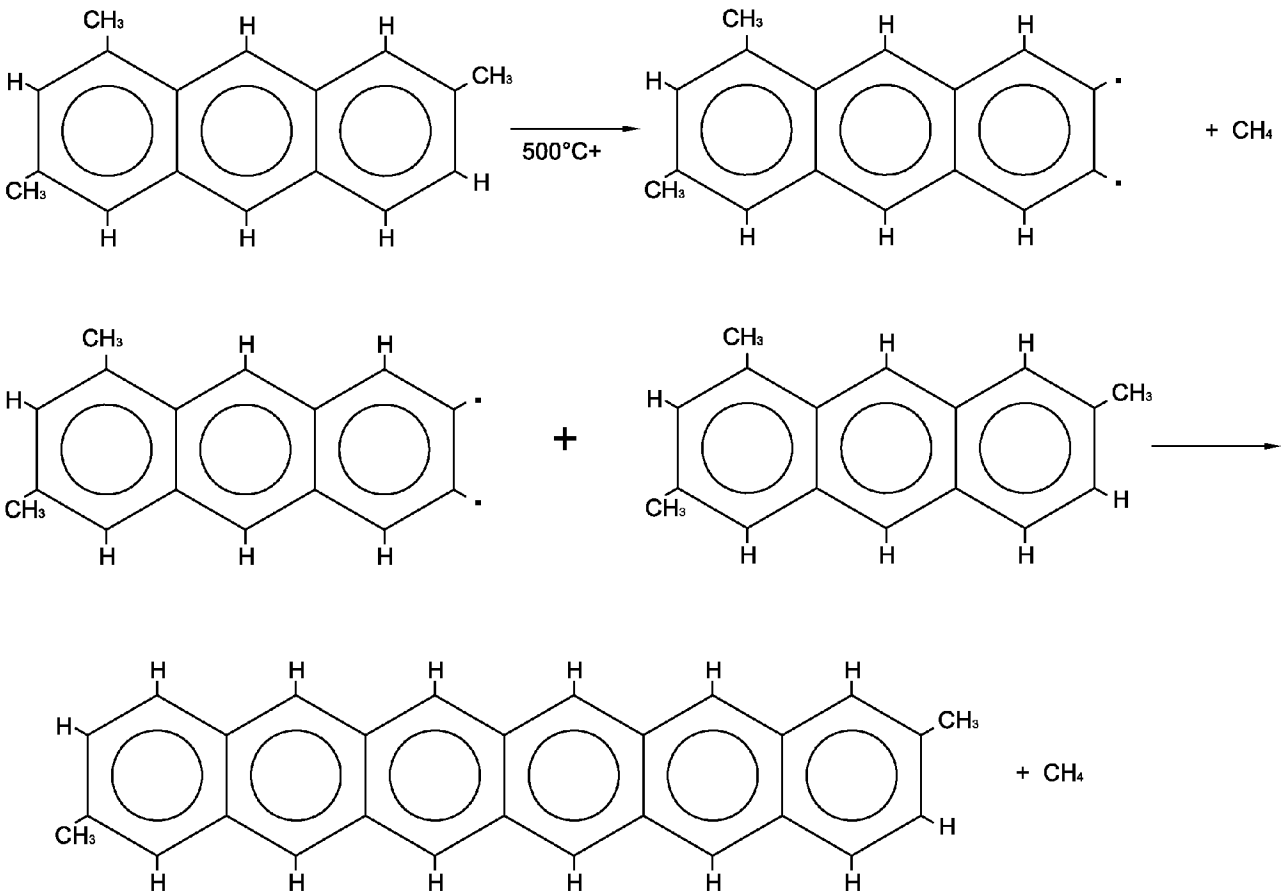
FIG. 5 illustrates two chemical reactions considered to be important in the production of pitch.

When an alkyl group and/or hydrogen are removed from an aromatic ring, the ring becomes a radical that is highly reactive. The radical can attack another aromatic ring resulting in the second broad type of reaction, condensation, where the two rings are fused into a larger condensed aromatic ring. FIG. 5 illustrates these two types of reactions in the most basic way. The top or first reaction is dealkylation. The second or lower reaction is condensation. If condensation occurs over multiple instances, it may be considered to be polymerization or oligomerization. There are many different types of fused multi-ring aromatic compounds in the feed, and there are many pathways for these reactions to proceed resulting in a multitude of possible products. The reactions shown in FIG. 5 are given only for illustrative purposes. The reactions shown may not be the most likely to occur. The isomers shown may not even be present in some feeds.

If condensation/polymerization proceeds too far, coke is produced. Coke is almost entirely carbon. It does not melt or dissolve. Coke frequently forms on hot solid surfaces. Once formed on surfaces, coke can only be removed by extremely vigorous mechanical cleaning or combustion. As coke builds up on surfaces of equipment, it restricts fluid flow and impedes heat transfer. Coked equipment must be taken out of service to remove coke deposits. Coke formation is an important commercial consideration. Excessive coke formation can cause an otherwise profitable process to be uneconomical. Operating conditions and configurations must be carefully balanced to facilitate the rapid production of HAP, but minimize coke formation.

Feedstocks

The new pitch (HAP) making process described herein can use any feedstock so long as it is sufficiently aromatic and has an appropriate boiling range. These materials are often characterized by methods developed by the American Petroleum Institute (API). A feedstock having an API gravity between −10° and +10° with an initial atmospheric boiling point greater than 288° C. (550° F.) and a final atmospheric boiling point of less than 704° C. (1,300° F.) is preferred. Although not preferred, the process can tolerate feedstock having an initial boiling point of 500° F., 450° F., or even 425° F. to 400° F. These lighter feedstock materials can be used but generally do not have enough multi-ring aromatic compounds, and also contain too much readily vaporizable materials to make ideal feedstock.

The petroleum stream most likely to meet the above requirements is slurry oil, sometimes referred to as decant oil, from refinery fluid catalytic cracking (FCC) operation. Distillation or other commercial separation processes may be able to create an acceptable feed from an otherwise unacceptable feed.

Ethylene cracker bottoms (ECB) are similar to slurry oils from FCC and can be used as feedstock. ECBs are derived from petroleum and are highly aromatic. Some fractionation or other feed preparation may be beneficial.

Coal tar can be used. Coal tar frequently contains impurities or chemical species that interfere with downstream uses. Our process tolerates small amounts of solids well, but some pretreatment to remove solids or quinoline insolubles may be needed. Coal tar light oil, middle, or middle heavy creosote oil and the like derived from destructive distillation of coal may also be used. All such liquids contain aromatic rings and may be used, though not necessarily with equivalent results.

In general, the process works best when the feedstock contains little or no water, little or no gasoline boiling range material, and with essentially all of the feedstock preferably in the distillate boiling range. As used herein, gasoline could be a light naphtha fraction, boiling below 350° F. or even a heavy naphtha fraction with an end boiling point of 400 or even 425° F. Preferably the feed is a distillate boiling range material and preferably most of the feed is aromatic.

Although our process permits one to take a conventional feedstock, e.g. a slurry oil, and convert it in a single step to a pitch product, it is also possible to operate with a feedstock which has been subjected to some other conventional pitch conversion process. As an example, the prior art pitch processes usually operated with very modest conversions per pass. It is possible to charge a feedstock containing some isotropic pitch, say between 0 and 5 wt % isotropic pitch, or even up to 10 wt % isotropic pitch, and upgrade this low softening point material using the process of the present invention. This approach may be especially beneficial when a prior art process can not make an isotropic pitch with the desired coking value. Such off spec pitch product can be upgraded or converted to a higher softening point isotropic pitch by being charged to a tubular reactor in accordance with the teachings herein. It is important that any charge stock not have significant mesophase content, as any mesophase material in the feed will remain as mesophase material or be converted into coke.

Although a single tubular reactor is preferred for formation of isotropic pitch, it may be beneficial in some circumstances to remove some light ends between the inlet and outlet of the tubular reactor. When processing a low quality feedstock, either one contaminated with a significant amount of light distillate and gasoline boiling range material or one which is overly paraffinic, it may be difficult to maintain a pressure high enough to suppress mesophase formation. In such circumstance, having an intermediate flash drum or cyclone separator to remove at least a portion of light distillate or gasoline boiling range material may be beneficial Process Conditions Many processes have been proposed to produce HAP from feeds described above. Most of these processes require multi stage treatment of feed and/or very low conversion per pass and/or significantly lower pressure.

Time and temperature are important and closely related variables. Temperature and a preferred method of heating the tubular reactor will be discussed first, followed by a discussion of reaction time, pressure required, and conversion or reaction severity.

Heating Method

We prefer to use the electrically heated tubular reactor described in conjunction with the review of the Figures. This heater permits precise control of temperature throughout the tube, with little variation from the tube inlet to the tube outlet. Use of electric resistance or induction heating permits the tube to be heated, but hotspots to be avoided. Maintaining vigorous flow throughout the length of the tube minimizes temperature excursions from the tube wall to the center of the tube.

Other temperature profiles are possible where one wants to impose an increasing or decreasing temperature profile. Some operators will prefer to use temperature profile to change process conditions to account for variations in available feedstocks or product required. For simplicity, many will prefer to charge a relatively cool, or at least much cooler than the desired thermal reaction temperature, feed to the inlet and allow a portion of the tubular reactor to operate as a preheating section.

Salt baths are another good way to obtain the even heating desired. Salt baths have been used for almost a century for heating petroleum fluids, such as the Houdry case thermal cracking reactors developed in the 1920s.

It may be possible to design and run a fired heater that can achieve the desired gentle uniform heating. The feed may be preheated in a direct fired portion of the heater with the tubular reactor within and heated by the convection section of the heater. Feed in the preheater portion likely will not enjoy even heating, but the temperatures are well below coking temperatures so minor hot spots on the tube can be calculated. As no combustion occurs downstream of the direct fired portion of the heater, the tubular reactor may be heated by the hot combustion gas discharged from the heater, and this hot gas does not generally create hot spots.

Although any type of heater may be used so long as it avoids hot spots, we prefer electric heating for superior control of temperature.

Thermal Reactor Temperature

Regardless of the method used to heat the tubes, we prefer that the temperature in the thermal reactors varies by less than 5° C., preferably less than 2 or 3° C., from inlet to outlet and may be controlled to within 5° C., preferably within 1° or 2° C., of the desired reaction temperature. It is acceptable to have some portion of the tubular reactor operate at relatively low temperature as a preheater. It is also possible to have staged temperatures, i.e. starting with a relatively low temperature and progressively increasing temperatures. We prefer for simplicity of operation and control to run the tubular reactor at one temperature and to keep the temperature from inlet to outlet essentially uniform and to maintain velocity and mixing intensity in the tube sufficient to keep the maximum temperature difference, measured from the tube inner wall to the tube centerline, below 2° C., preferably below 1° C., and ideally 0.5° C. or less.

Depending on the residence time of the feed in the tubular reactor, the temperature can vary greatly from 850° to 1050° F., preferably 910° to 990° F., and more preferably 930° to 970° F.

Thermal Reactor Residence Time

Residence time in the tubular reactor can vary greatly. As stated previously, time and temperature are both necessary for determining the severity of a given reaction. Perhaps the easiest way to specify time, or rather time at a given temperature, is in functional terms, namely the degree of conversion of aromatic rich liquid into a pitch product. For purposes of this exercise, pitch product could be considered as that material with a softening point above 80° C., preferably above 100° C., or even higher. Laboratory work with a certain feedstock or short runs in a commercial plant can determine what time and temperature are required to achieve a required conversion. Once this has been done, this severity of operation can be used with only minor modifications in other plants.

In general, we prefer short residence times with fluid velocities, tube length, and temperature being adjusted as needed to stay with the short residence time. We believe that best results will be achieved when the liquid residence time is 2 minutes or less, preferably one minute or less.

Pressure/Liquid Phase

We knew that high pressure helped pitch manufacture. We learned that high pressure, high severity, and turbulent flow in a small tube did not always work.

We ran our tests in a longer tubular reactor with a 900 psig tube outlet pressure. In one series of tests, we added roughly about 1 to 10 wt % steam to the feed with most of the tests done at 10 wt % steam addition. The intent was to see what would happen with steam addition, in the hopes that coking would be reduced. We knew that the steam would be in the vapor phase going through the tube and reduce the residence time of the liquid, roughly by a factor of 4, and set our temperature to maintain the same thermal severity. Less liquid residence time made some of the worst product to date with 12.5 wt % mesophase in the pitch product. When we omitted the steam and increased the liquid feed rate by the same factor to ensure that the liquid residence time, and thermal severity in both runs would be the same, we made the best product to date—most of the feed was converted into pitch in a single pass and the mesophase content of the isotropic pitch product was 0.1 wt %.

We have not done a complete set of experiments to determine the lower limits of operation which can produce a good isotropic pitch product, but are confident that a pressure of 300 psig or less, which is where essentially all the prior art pitch processes operated, is too low. With pressures of 300 psig or less, a significant amount of the feed and transient intermediate products will be in vapor phase.

The process can perhaps work with pressures as low as 400 psig, but that may require careful feed pretreatment to produce a sufficiently heavy charge stock. We believe that 500 psig is a practical minimum, with higher pressure preferred. We ran our experiments at 900 psig outlet for the tubular reactor and achieved good results, as long as we did not add steam to the feed.

We believe that high pressures, coupled with high mixing intensity and/or shear, allow some saturation of unsaturated species. Our theory, that some sort of in-situ pressure induced hydrotreating is going on in the tubular reactor, may be wrong, but the gasoline and light gas fractions coming out of the reactor are different than like fractions from prior art pitch processes. One of the most striking differences is the amount of gasoline boiling range material, much less than in prior art processes. In addition to being a smaller stream, it is of significantly higher quality, in terms of reduced diene and olefin content. In terms of the amount of olefinic and dienic material produced, we believe that our process makes much less than half as much as prior art processes, and perhaps less than one tenth as much.

Our conversion "target" is significantly higher than that used in the prior art. The prior art pitch plants made pitch in multiple stages, with the first stage of thermal treatment being little more than dealkylation or limited thermal polymerization.

The first stage of U.S. Pat. No. 4,925,547 produced a "thermally cracked heavy oil" after heat treating in a tubular reactor at 470-520° C., 20 Kg/cm2, the reactor having an id of 6 mm, 40 m length. This heavy oil had some pitch components but was not close to being a pitch product.

The U.S. Pat. No. 3,140,248 patent first stage thermal treatment yielded "thermal asphalt" with some pitch components, as evidenced by a 158-160° F. softening point. This thermal asphalt required further treatment in a soaking zone to make product pitch. The conversion per pass in the first stage was low, the examples showed a 3:1 recycle ratio. The process was run at 400 psig outlet pressure. It produced significant amounts of gasoline, and lighter, material. The yield of gasoline was 16.0 to 15.3 wt % in several examples as compared to yields of "thermal asphalt" of 62.8 to 61.0 wt %, all yields based on syntower bottoms charged. While the process made some pitch, or pitch product precursors, the gasoline:pitch precursor weight ratio was about 1:4. Production of so much gasoline also required multi-tray fractionation of the first stage reactor effluent, i.e., there was so much gasoline produced that simple sequential condensation of vapors to recover a gas oil recycle fraction, then a gasoline rich fraction could not be done. There would either be too much gasoline in the recycle gas oil or too much gas oil lost with a gasoline rich fraction, unless fractionation was used to separate more cleanly the various fractions.

Our conversion "target" is to make pitch that can be used as a product. We prefer to remove volatiles from the pitch fraction either by simple flashing at a slight pressure, atmospheric, mild vacuum, or harder vacuum.

For purposes of calculating a range of residence times that will work, the use of ERT severity or Equivalent Reaction Time at 800° F. gives a close approximation of times and temperatures needed to achieve a desired result. If everything else is the same, and an operator wants to reduce the temperature in the coil 18 F, then doubling the length of the tubular reactor will achieve equivalent thermal treatment of the feed.

The new pitch (HAP) process described herein incorporates a number of features that maximize pitch yield while minimizing coke formation. Dealkylation and condensation reactions generally occur at a similar to significantly higher temperature and a higher pressure than previously described processes. The reactions occur in conduit at a severity and velocities significantly higher than in previously described processes. One prior art process, U.S. Pat. No. 4,925,547, had relatively high liquid velocity in the reaction tube, but the severity was much lower, as only a thermally cracked oil was produced in that stage, rather than a pitch product. The pressure drop resulting from friction loss due to flow varies from 50 to 200 psi across the reaction zone.

Tubular Reactor Flow Conditions

It is hard to estimate flow conditions inside the tubular reactor. The composition of the fluid flowing through the tube changes all the time, as does the vapor fraction. There will be some vaporization of lighter boiling feed components due to high temperatures. There will be significant changes in feed composition as thermal dealkylation, thermal cracking and thermal polymerization reactions compete with one another.

Reynolds number is a dimensionless number and a good way of characterizing the kind of flow that is needed to make the process work, although hard to apply with accuracy to our process due to two phase flow. Laminar flow typically occurs in pipes when the NRe is below about 2300 while turbulent flow occurs above 4000. Although turbulent flow, almost by definition, implies that the velocity in a pipe is the same across the pipe, the common use of this term ignores the significant boundary layer that forms near the pipe wall. When turbulent flow is just occurring, there will be a significant boundary layer near the tube wall where fluid moves slower. It is essential in our process to have a sufficiently high NRe so that there is very little in the way of a boundary layer. Some boundary layer can be tolerated, as a slightly longer residence time does not equal coke formation.

Flow in the tube is believed to be fully developed turbulent flow. We checked temperature along the tube and had two thermocouples inside the tube and temperatures were always essentially the same. Temperatures along the tube length are primarily a measure of the even heating method used, while lack of dT from the tube wall to the centerline of the tube shows good mixing. There may be a boundary layer, but it is so small that it does not affect residence time and there is little mesophase formation.

It should also be recognized that coke formation on tube walls will be influenced by feed quality, surface of the tube, presence or lack of hydrogen. Steam was generally thought to retard or remove coke formation, but based on the increase in mesophase production, the net effect of steam addition in this process may be to increase coke formation and create undesired mesophase contamination of the product.

A NRe above 10,000 is preferred, with an NRe above 25,000 giving better results. Operating with higher NRe, such as 50,000 or even above 100,000 will give the best results in terms of minimizing coke formation and fouling on tube walls, but there are offsetting equipment and operating costs which must be considered.

Although it is possible to give arbitrary estimates of NRe, in practice this number is exceedingly hard to calculate. Although the temperature in the tubes remains remarkably constant throughout the process, the vapor/liquid ratio changes constantly due to changes in pressure and composition changes as various byproducts are formed. Some of the normally liquid components of the feed become less viscous as their molecular weight is decreased due to cracking or dealkylation, something akin to that which occurs in the classic visbreaking process. The pitch or product of thermal polymerization constantly increases in viscosity. Thus the practical difficulties of calculating NRe may preclude its use for day to day operation. NRe is still a useful concept for understanding the nature of the fluid flow in the thermal reactor, and it is possible to calculate it using average compositions for either the whole or segments of the tubular reactor.

Shear rate is another important factor and may be more useful than NRe. In turbulent flow shear rate is greatest near the wall and decreases rapidly toward the center of the pipe or tube. It is zero in the center. As the vapor fraction increases along the length of the conduit due to thermal reactions, the flow regime in the conduit tends toward annular or mist annular where all of the vapor and some of the liquid flows at high velocity in the core of the conduit while an annular ring of liquid flows along the conduit wall. In this circumstance nearly all of the shear rate occurs in the liquid film. Quantitative characterization of the shear rate is not generally possible, but the shear rate is proportional to the pressure drop due to flow per length of conduit. Typical pressure drop per unit length for our experiments were in the range of 0.05 psi/ft to 1 psi/ft.

Feed Filtration

Many feeds contain small amounts of solid contaminants or materials that readily form solids. It is usually beneficial in terms of meeting product demands that these contaminants be removed.

Coal tar contains enough solids and undesirable species that solvent extraction has been used to remove them, e.g., solids and xylene insoluble as in the U.S. Pat. No. 4,925,547 patent. This type of pretreatment of coal tar is beneficial, but not essential for the practice of our invention provided the offending material left in the coal tar is acceptable in the product or can be removed by filtration.

Slurry oil often contains a small amount of catalyst from the FCC process. FCC catalyst is predominately an alumino silicate with trace amounts of other metals. The typical range for ash in slurry oil is 0.01% to 0.05% wt. Feed slurry oil for some HAP applications where even low particulate levels are unacceptable can be filtered to remove virtually all FCC catalyst. To date, applications where extremely low levels of particulate are required have filtered HAP because commercial producers of HAP did not need to produce particulate levels this low for most of their customers. Filtering HAP is much more difficult and expensive because HAP is significantly more viscous than slurry oil. HAP filtration must be performed at a temperature of at least 204° C. (400° F.) and often higher in order to get a reasonable filtration rate. A filtration temperature this high precludes the use of many filter media that would otherwise be economically attractive for this application.

After producing HAP with the above described particulate in the slurry oil, we decided to remove all particulate from the slurry oil before producing HAP so that the HAP would be ash free.

Thermal Reactor Tube

The tube used to form the thermal reactor of the process should be selected to have sufficient hardness, and inertness, to withstand the severe conditions.

Tube Heating Method

In experiments, the electric heating method discussed in conjunction of the review of the Figures was used, but the invention is not limited to such a heating method. It will also be possible to use a tube that is immersed in a salt bath or molten metal bath, the convection section of a fired heater, or perhaps even in the radiant section of a fired heater. There may be problems with these other approaches such as shorter run lengths due to localized high temperatures or some reaction of the tube with salt or molten metal, but the thermal reactions experienced by the feed will be the same. Any heating method can be used which in practice, and this includes the volume and velocity of material flowing through the tubes, allows the feed to be heated to the desired temperature without exposing the feed to hot spots.

A metal tube was used in our experiments, but it is also possible to operate with a ceramic tube or metal tube which has a ceramic or other impervious coating on the inside wall of the tube. This ceramic tube can be heated in an encasing metal layer or heated by immersion in a salt bath, molten metal bath or a conventional heater. The purpose of the tube is to contain the product not to catalyze any reactions.

Different types of tubes and heating methods are discussed to clarify that what is different about the process is not so the materials used to form the reactor tube nor the method of heating the reactor tube, but rather the unusually short residence time, high velocity and high Reynolds number, high pressure and high severity, or high conversion.

The preferred reactor design using metal tubes and electric heating is a new apparatus, a compact, robust simple design which affords, for an industrial process, almost the temperature control of a salt bath or molten metal bath, but with none of the mechanical difficulties or concerns about corrosion which are a concern when tubes are immersed at high temperature into either salt or molten metal.

The pitch products of the process are also believed to be unique. In all prior pitch processes from Father Noah's to the present, there is some variation in thermal severity. In Father Noah's time, constant and rapid stirring of the pitch pot would reduce, but not eliminate, variations in severity of thermal processing of the feed. In pitch processes using air combustion, fired heaters, or recirculation, there was some variation in severity of pitch processing. In two stage pitch processes, such as '547 and the Bell patent, the first stage of processing makes an intermediate product, then a second stage of processing makes pitch. In '547 there is very uniform processing in the first stage to make the intermediate product, but the product separation step and to a lesser extent the second stage or soaking step spreads out the residence time of the feed.

The process of the present invention using fully developed turbulent flow subjects each pitch precursor molecule to an almost identical severity of thermal processing. The product will be very uniform, and the lighter molecules which are the byproduct of the thermal cracking and dealkylation reactions occurring during processing will have less olefin and diene content than a similar pitch product made using any prior process. To some extent the reduced olefin and diene content is due to ensuring that no feed molecules experience unintended severe cracking due to long residence time. Most of the reduction in unsaturated content is probably due to the high pressure and vigorous mixing allowing reactive unsaturated species produced during the course of thermal treatment to react with partially converted pitch molecules.

The process of the present invention affords better control of thermal polymerization. This can be important when tight control of product and even of byproduct properties is necessary. If the feed has certain properties, i.e., a narrow boiling range, then it is possible to make pitch products that will have desired specifications with less fractionation or other treatment. The pitch products of our process will inherently be more uniform as they were all subjected to essentially the same thermal treatment, unlike prior processes that have more variation in thermal processing and produce a more varied product. Although the differences are not as pronounced, the careful control of product properties is somewhat analogous to the different spectrum of an incandescent source as opposed to a laser. The process permits finer tuning of process conditions and product properties.

This fine tuning and narrow residence time of aromatic liquid in the thermal reactor may also contribute to a higher coking value pitch. As shown by the examples, the process of the present invention can produce pitch with a softening point of 95° C. and coking value of 50 wt %, and pitch with softening point of 111° C. and coking value of 55 wt %. These coking values are significantly higher than heretofore achievable in a petroleum pitch.

The conversion of feed to product pitch and byproducts is unusual in our process. In prior art pitch processes, significant amounts of feed were converted to gasoline and lighter materials. Although this material had some value it was not the desired product, further it complicated the design and increased running costs of the pitch plant. No continuous process can achieve complete conversion of feed to pitch in one pass, so for a commercially viable operation, the unconverted distillate boiling range material must be recycled. Gasoline or light distillate production could be considered a "toll" on the road to pitch, a high price that must be paid to get through to pitch. Prior art processes exacted a "toll" of 1 weight of gasoline for every 4 weights of pitch product. Our process produced pitch with a much reduced "toll" rate, less than a tithe of isotropic pitch production.

Such tolls are costly because the gasoline and light distillate material are not pitch, nor can they be recycled to form more pitch. They do not contain enough aromatics to be a suitable pitch forming feedstock. They vaporize in the thermal reactor if recycled, and this is bad as the desired pitch forming polymerizations occur in liquid phase. The gasoline distillate material is close enough in boiling range to the gas oil material so that simple flashing and condensation cannot be used to separate gasoline from distillate. The gasoline can easily be separated in a multi-stage fractionator, but fractionation is a significant capital and operating expense.

In our process, the amount of gasoline or light distillate is so low that it is possible to use a simple flash drum on the thermal reactor effluent to vaporize all the distillable material, followed by sequential coolers to condense from these vapors a gas oil phase which is recycled and then condense a gasoline and light distillate phase which is removed. We run the temperatures and pressures to recover and recycle gas oil boiling range material and reject a modest gasoline fraction. This gasoline fraction of course contains significant amounts of heavier materials, as simple cooling will not fractionate our gasoline material, but the amount of gasoline is so small that the loss of some potential recycle material can be tolerated.

Our process produces more isotropic pitch per pass than any continuous process heretofore developed, but very little gasoline. By way of comparison, the visbreaking process developed and licensed by Universal Oil Products thermally cracked a feed to produce a guaranteed minimum yield of 23% gasoline. Coking which is a more severe process converts much of the feed into coke and the rest into lighter materials. Coking typically produces 13-20 wt % naphtha boiling range material. In contrast, in our process the yield of gasoline is typically 1 or 2 wt % of the feed, $1/10^{th}$ or less that of prior art thermal processes. We believe that some of the reduced yield of gasoline is due to the high pressures of our process. This pressure is sufficient to keep some portion of the light and heavy naphtha transient product in the liquid phase where it has a chance to react with polymerizing aromatic molecules. It is possible that some other not understood reaction mechanism is involved in suppressing gasoline yields in our pitch process. We are not sure why so little gasoline is made, but we achieve pitch yields more than 10 times gasoline yields by weight. The reaction conditions used in our experiments are believed very close to those which will be suitable for larger commercial plants processing different feeds with similar boiling range, e.g., slurry oils from cat cracking units.

Some functional guidelines can be given on how the process should be run. It is important to have sufficiently severe thermal processing to convert at least 20 wt % per pass, and preferably 25 wt % or more of the liquid feed to the desired isotropic pitch product. Pressure is also a critical variable, both to reduce mesophase formation to levels that can be tolerated in the product and to reduce gasoline yields. Mesophase formation is probably reduced by some mechanism involving keeping much or almost all of the multi-ringed aromatic structures in liquid phase. The exact mechanism for the reduction of gasoline yields is not known. Intuitively, one would expect that as processing severity increased to achieve the required conversion levels, the gasoline yields would increase. In all other thermal processes, from visbreaking to coking, gasoline yields and the olefin and diene content thereof increase with increasing severity. The higher pressures used probably promote olefin dimerization or polymerization, or higher pressures may favor the formation of higher molecular weight products and thus increase the yields of pitch and reduce yields of gasoline.

The mesophase content of the product must be kept at a low level to produce a good product. Mesophase is also just a step away from coke formation and should be avoided for that reason.

To ensure that a plant is operated properly, it would be a good practice to start fresh feed, or fresh feed and recycle material flowing as temperatures in the plant increased. Thermal severity or conversion should be increased until the desired conversion is achieved. It is possible to monitor the relative amounts of gasoline, recycle oil, and pitch product produced. At first there will be little or no product, but as severity increases greater amounts of pitch are produced. Gasoline yields will increase with increasing severity, but in our experience, the ratio of gasoline to pitch product will decrease at the relatively high conversion levels used. While mesophase production is especially sensitive to pressure, the low levels of mesophase in the product and the need to cool and polish a sample for optical inspection may make this approach unsuitable for close control of the process. The ratio of gasoline to pitch is not a product constraint but is a sensitive indicator of how the plant is operating. Severity can be increased until the ratio of gasoline to pitch, or gasoline to recycle oil, or light gas to pitch, or some other similar ratio, can be used to judge the severity of the process.

Because of our higher pressure operation, we can tolerate significant amounts of lower boiling materials not usually considered good feedstocks for pitch production. We prefer multi-ring aromatics, preferably with three or more aromatic rings, but our high pressure operation allows some of the lighter aromatics to polymerize and form pitch, either by reaction with other multi-ring aromatics or from some reaction with lighter materials fed to or generated in our process, such as gasoline and light distillate boiling range materials.

Our process allows petroleum pitch to be made with a softening point and coking value that approaches these values in coal tar pitch. Coal tar pitch has significant levels of known carcinogens, but petroleum pitch can be made with less than half, preferably less than a tenth, the carcinogen content of a like softening point and coking value coal tar pitch. Some typical coal tar carcinogen levels are reported below:

Concentration of BaP and BeP in coal tar pitch
Benzopyrenes in the environment
Benzopyrenes lives in some industrial prodducts

| Sample | BaP | BeP | Reference |
|---|---|---|---|
| Coal | Identified not quantified | | Woo et al (1978) |
| Carbon | 2-40 ug/g | | |
| Coal Tar pitch | 1.29-2.44% | | |
| Asphalt | 0.1-27 mg/kg | | |

Using our process, it is possible to make petroleum pitch with an order of magnitude less carcinogen content as compared to a coal tar pitch, which is in line with reduced carcinogen content of petroleum pitches.

The process can be improved by in some cases by adopting some recycling or conversion paths. Preferably the flash vapor produced is cooled in a cooling means sufficiently to condense at least a majority of unconverted or partially converted pitch feedstock, which is recycled to a tubular or pipe reactor for thermal polymerization to form additional amounts of isotropic pitch, and leave at least a majority of gasoline and lighter material as a vapor phase which is withdrawn as a product of the process.

Preferably thermal polymerization conditions are selected to produce an order of magnitude more isotropic pitch product than gasoline boiling range material, by weight.

Mention of a reference in the specification is intended to incorporate by reference said reference in its entirety herein.

We claim:

1. A process for producing isotropic pitch comprising charging a feed comprising distillate boiling range aromatic rich liquid and an optional distillate boiling range recycle material to an inlet of a tubular or pipe reactor and heating said feed within said reactor at a temperature sufficiently high to induce thermal polymerization of said feed and a pressure sufficient to maintain at least a majority by weight of said feed in liquid phase, and passing said feed through said reactor for a time sufficient to convert at least a portion of said feed to isotropic pitch and gasoline boiling range material, discharging from said reactor an effluent stream comprising pitch product and byproducts, and recovering isotropic pitch as a product of the process and wherein the time and temperature in said reactor create thermal conditions sufficient to convert at least 20 wt % of said feed and any recycle material which may be present to isotropic pitch and said pressure is sufficiently high to suppress mesophase formation to produce an isotropic pitch product containing less than 0.5 wt % mesophase.

2. The process of claim 1 wherein said residence time is less than 2 minutes.

3. The process of claim 1 wherein said reactor operates at a temperature of 900° to 1100° F.

4. The process of claim 1 wherein said reactor operates at a pressure of 500 to 5000 psig and said mesophase content of said isotropic pitch product is less than 0.5 wt %.

5. The process of claim 1 wherein residence time of said feed in said reactor is less than 1 minute.

6. The process of claim 1 wherein said reactor is a metal tube heated by electric resistance and/or inductance heating.

7. The process of claim 1 wherein said reactor is immersed in a molten salt or molten metal bath.

8. The process of claim 1 wherein said reactor effluent is flashed or fractionated to recover a residual isotropic pitch fraction and a separate liquid fraction comprising aromatic rich liquid boiling in the distillate range which is recycled and wherein severity in said reactor converts sufficient feed to yield at least 50 wt % isotropic pitch having a softening point above 100° C., based on weight of said distillate boiling range aromatic rich liquid feed.

9. The process of claim 8 wherein said reactor effluent is flashed to produce a liquid fraction of isotropic pitch product and a vapor fraction, said vapor fraction is cooled at a temperature and pressure sufficient to condense at least a majority of said distillate boiling range material in said effluent and produce a cooled vapor fraction comprising at least a majority of said gasoline boiling range material.

10. The process of claim 1 wherein said feed is selected from the group of coal tar, ethylene cracker bottoms, a slurry oil, and a clarified slurry oil from a catalytic cracking unit.

11. A method of converting slurry oil into isotropic pitch, comprising a. charging a feed comprising slurry oil having a boiling range to a tubular or pipe reactor operating at a temperature above 900° F. and passing said feed through said reactor at a velocity of at least 1 m/s for a time sufficient to provide an effluent comprising at least 20 wt % of an isotropic pitch product, unconverted or only partially converted material boiling within the same boiling range as the feed and lighter materials produced as a result of thermal cracking, thermal dealkylation, or thermally induced polymerization of said feed, and wherein a pressure in said reactor is maintained above 500 psig and sufficient to suppress mesophase formation to less than 1.0 wt % in said isotropic pitch product;

b. discharging into a flash drum operating at a pressure less than 1/10th said pressure in said reactor said pitch, said unconverted or partially converted feed and said lighter material;

c. flashing from said flash drum a vapor phase comprising said unconverted or partially converted feed and said lighter material from a residual liquid phase comprising said isotropic pitch;

d. cooling said vapor phase removed from said flash drum sufficiently to condense at least a majority by weight of said unconverted or partially converted feed, charging said cooled vapor phase into a separation vessel and separating therein a liquid phase comprising said unconverted or partially converted hydrocarbons and a vapor phase comprising at least a majority, by volume, of said lighter material;

e. removing from said separation vessel and recycling said liquid phase to a reactor and removing a vapor phase comprising said lighter material.

12. The process of claim 11 wherein said reactor operates at a temperature of 950° to 1050° F.

13. The process of claim 11 wherein said reactor operates at a pressure of 900 to 5000 psig.

14. The process of claim 11 wherein residence time of said feed in said reactor is less than 2 minutes.

15. The process of claim 11 wherein said reactor is heated by electric resistance or inductance heating.

16. The process of claim 11 wherein said reactor is immersed in a molten salt or molten metal bath.

17. The process of claim 11 wherein said reaction conditions include a severity sufficient to convert at least 25 wt % of said feed and any recycle material which may be present to pitch product, said lighter material comprises gasoline and severity is controlled to produce at least an order of magnitude more pitch by weight than gasoline, and pressure is sufficient to reduce mesophase contamination of isotropic pitch product below 0.5 wt %.

18. A process for thermally polymerizing an aromatic rich liquid obtained as a heavy product from the a fluidized catalytic cracking process to produce isotropic pitch comprising a. charging a slurry oil, clarified slurry oil, or filtered slurry oil feed to a tubular or pipe reactor having an inlet and an outlet and passing said feed through said reactor at thermal polymerization conditions including a temperature above 900° F., an average liquid velocity of at least 1 m/s, and outlet pressure of at least 500 psig to produce a reactor effluent comprising at least 20 wt % isotropic pitch, unconverted feed or partially polymerized material and lighter liquid products having a lower boiling point than said feed and comprising gasoline boiling range materials and normally gaseous products;

b. discharging said reactor effluent into a flash drum operated at a pressure from sub-atmospheric to 50 psig and flashing therein said effluent to produce a liquid phase comprising isotropic pitch having a softening point above 80° C. and a vapor phase comprising unconverted or partially converted feed, gasoline boiling range material, and normally gaseous hydrocarbons, c. removing from said flash drum said liquid phase comprising isotropic pitch as a product of the process and a flash drum vapor phase;

d. cooling said flash drum vapor phase at a temperature and pressure sufficient to condense at least a majority by weight of said unconverted or partially converted feed and produce a flash drum cooled vapor phase and condensed liquid phase which is charged to a vapor liquid separator;

e. separating in said vapor liquid separator said cooled vapor and condensed liquid and withdrawing a liquid phase containing a majority of said unconverted or partially converted feed and a vapor phase comprising at least a majority by weight of said gasoline boiling range components;

f. analyzing at least periodically said isotropic pitch product for mesophase content and maintaining said pressure sufficiently high maintain to suppress mesophase formation in said reactor and reduce mesophase contamination of said isotropic pitch product to a predetermined level below 1 wt %.

19. The process of claim 18 wherein said flash drum operates at or near or below atmospheric pressure and stripping steam is injected into said flash drum to remove additional amounts of unconverted or partially converted feed and produce as a product of the process a liquid phase of petroleum pitch having a softening point above 100° C. and coking value of at least 50 wt %.

20. The process of claim 18 wherein said condensed liquid phase containing a majority of said unconverted or partially converted feed is recycled to a tubular reactor and thermally polymerized to produce isotropic petroleum pitch and said produced isotropic petroleum pitch is discharged into said flash drum.

* * * * *